US006164112A

United States Patent [19]

Frigerio

[11] Patent Number: 6,164,112

[45] Date of Patent: Dec. 26, 2000

[54] ADJUSTMENT AND TENSION CONTROL DEVICE FOR A MULTIPASS WIRE DRAWING MACHINE

[76] Inventor: Marco Frigerio, Via Roma 27, 23827 Lierna, Italy

[21] Appl. No.: 09/184,056

[22] Filed: Nov. 2, 1998

[30] Foreign Application Priority Data

Nov. 11, 1997 [IT] Italy ..... MI97A2514

[51] Int. Cl.[7] ..... B21C 1/10

[52] U.S. Cl. ..... 72/280; 72/289

[58] Field of Search ..... 72/280, 288, 279, 72/289, 285

[56] References Cited

U.S. PATENT DOCUMENTS

| | | | |
|---|---|---|---|
| 935,564 | 9/1909 | Thompson | 72/285 |
| 1,178,331 | 4/1916 | Marvin | 72/280 |
| 1,354,336 | 9/1920 | Pierson | 72/289 |
| 3,812,702 | 5/1974 | Benteler | 72/280 |

FOREIGN PATENT DOCUMENTS

| | | | |
|---|---|---|---|
| 959904 | 3/1957 | Germany | 72/279 |
| 2445945 | 4/1976 | Germany | 72/285 |

*Primary Examiner*—Daniel C. Crane
*Attorney, Agent, or Firm*—Guido Modiano; Albert Josif

[57] ABSTRACT

A multipass wiredrawing machine particularly for drawing metal wires which comprises a plurality of reels for pulling a wire that exits from a corresponding die, the reels being arranged in sequence to wind the wire that exits from the die and guide it to a next die, each pulling reel being fixed, while the corresponding die can move with respect to the corresponding pulling reel, in order to maintain a substantially constant length for the portion of wire with respect to the corresponding pulling reel and allow the length of the portion of wire to vary with respect to the preceding pulling reel, so as to provide constant adjustment of the tension of the wire between the die and the reel and between the reel and the next die.

8 Claims, 2 Drawing Sheets

ADJUSTMENT AND TENSION CONTROL DEVICE FOR A MULTIPASS WIRE DRAWING MACHINE

BACKGROUND OF THE INVENTION

The present invention relates to a multipass wiredrawing machine provided with a device for adjusting and controlling the tension of the wire being processed, particularly adapted for drawing metal wires and the like.

In particular, the invention relates to multiple soap and wet wiredrawing machines.

The term "drawing" designates a kind of plastic cold working which consists in forcing the material, by pulling it, through the shaped hole of a die. The arrangement in sequence of a plurality of dies with holes having decreasing diameters allows to reduce the original diameter to the intended size.

It is known that in order to draw metal wires the wire passes through a die where its cross-section is reduced by plastic deformation.

Traction is applied by a pulling reel arranged downstream of the die which, by turning, winds on itself a certain number of turns of the wire.

In the case of multipass wiredrawing machines, the operation is repeated several times in succession by guiding the wire; accordingly, a plurality of dies are provided which are arranged in sequence, each die having a corresponding reel arranged downstream of it.

The wire is thus guided from one reel to the next die with a consequent reduction in diameter between one transfer and the next.

The drawing action must be applied so that the wire being processed, by generating friction on the pulling reel actuated by an electric motor, allows said reel to pull it (with a capstan effect), wind it and then guide it to the next reel.

Since drawing is performed without removing material, i.e., with a constant volume, the ratio between the cross-section and the speed of the wire becomes particularly important and must be kept constant for each pass through the various dies and respective reels.

Accordingly, at every reduction in the diameter of the wire, the wire becomes longer and accordingly each reel has progressively higher rotation rates in order to wind an increasingly longer wire.

The ideal situation would be to provide direct transfer of the wire from one reel to the next.

The essential requirement for correct operation is that the rotation rate of the individual reels must strictly match the tension variations of the wire that leaves the respective dies, adapting the rate to the elongations that the wire undergoes in passing through the various dies.

In practice, this theoretically ideal condition is difficult to achieve because it is difficult to precisely control the rotation rates of the individual motors that drive the reels and because of the variables that come into play during processing, such as die wear etcetera.

In order to obviate these drawbacks, wiredrawing machines have been used which accumulate wire between one reel and the next; more recently, machines provided with a dancer roll or bend detector have been used.

The latter are movable elements onto which the wire being processed is guided. Any variations in the elongation of the wire cause angular or straight-line movements of these elements which, by means of position transducers such as inductive transducers (potentiometers, encoders, etcetera) control and correct the speed of the corresponding motor, thus maintaining uninterrupted processing.

The above described conventional solution, however, has the drawback that they bend the wire around the movable elements, with bending which is sometimes too extreme to obtain optimum metallurgical characteristics of the wire.

Drawbacks also arise due to difficulties in constructing wiredrawing machines that adopt these solutions, in addition to difficulties in threading the machines.

Another solution that has been adopted recently in order to produce wiredrawing machines whose operation is as close as possible to the above described optimum condition entails controlling the speed of the Individual reels, detecting wire tension variations both in the portion between the die and the reel and between the reel and the next die.

The position of the reels and of the dies is fixed; accordingly, since there are no moving elements, control of the speed of the motors of the reels produces variable tensions on the wire in the portion between the reel and the next die.

SUMMARY OF THE INVENTION

The aim of the present invention is therefore to provide a multipass wiredrawing machine provided with a device for adjusting and controlling the wire being processed which allows to maintain direct traction of the wire without having to resort to devices for accumulating the wire or to dancer rolls and the like.

Within the scope of this aim, an object of the present invention is to provide a multipass wiredrawing machine provided with a device for adjusting and controlling wire traction which allows to maintain a constant tension on the wire in the critical traction portion between the die and the pulling reel and in the critical release portion between the reel and the next die.

Another object of the present invention is to provide a multipass wiredrawing machine which allows to draw wires made of different materials by means of the same machine.

Another object of the present invention is to provide a multipass wiredrawing machine which has a minimal number of constructive parts.

Another object of the present invention is to provide a multipass wiredrawing machine which is highly reliable, relatively easy to manufacture and at competitive costs.

This aim, these objects and others which will become apparent hereinafter are achieved by a multipass wiredrawing machine particularly for drawing metal wires which comprises a plurality of reels for pulling a wire that exits from a corresponding die, said reels being arranged in sequence to wind the wire that exits from the die and guide it to a next die, characterized in that each pulling reel is fixed, while the corresponding die can move with respect to the corresponding pulling reel, in order to maintain a substantially constant length for a portion of wire with respect to the corresponding pulling reel and allow the length of the portion of wire to vary with respect to the preceding pulling reel, so as to provide constant adjustment of the tension of the wire between the die and the reel and between the reel and the next die.

BRIEF DESCRIPTION OF THE DRAWINGS

Further characteristics and advantages of the invention will become apparent from the description of preferred but not exclusive embodiments of the multipass wiredrawing machine according to the invention, illustrated only by way of non-limitative example in the accompanying drawings, wherein.

DESCRIPTION OF THE PREFERRED EMBODIMENTS

Figure 1:
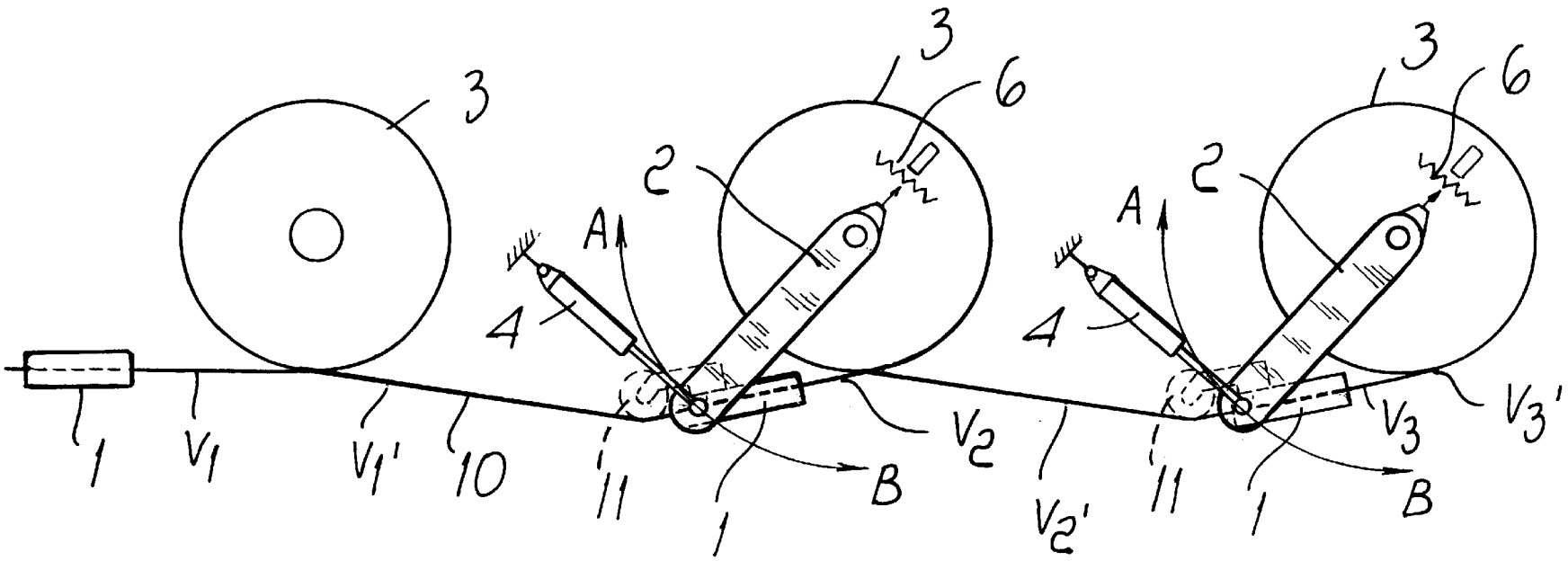
FIG. 1 is a schematic view of a first embodiment of the multipass wiredrawing machine according to the present invention.

With reference to the above figures, and particularly to FIG. 1, the reference numeral 10 designates a wire being processed, which passes through a die 1 and is wound onto a cylindrical body of a pulling reel 3.

V1 designates the speed of the wire 10 in the portion between the die 1 and the reel 3 and V1' designates the speed of the wire 10 in the portion between the pulling reel 3 and the next die 1.

The respective speeds V2, V2', V3 and V3' are designated likewise for the successive reels 3.

For correct operation of the wiredrawing machine, the following conditions must occur during operation:

at the speed V, the tension between the die 1 and the reel 3 must remain constant;

in the portion between the reel 3 and the next die 1, the speed V' must be equal to the speed V in the preceding portion.

In order to maintain a constant tension of the wire 10 in all the portions of the wiredrawing machine, there must be synchronization among one pulling reel, the pulling reel that precedes it and the one that follows it, so that there are no variations in the speeds V and V' (where V and V' here designate the speeds, for a generic reel, in the portions before and after the reel, respectively).

FIG. 1 illustrates a first embodiment of the wiredrawing machine according to the present invention, which comprises a plurality of pulling reels 3 and dies 1, each of which is supported by a movable arm 2 which is pivoted to the center of the corresponding pulling reel 3.

Each movable arm 2 is actuated by corresponding actuation means 4 which are rigidly coupled to the frame of the wiredrawing machine.

Each die 1 can therefore move along an arc A-B, consequently adjusting the tension of the wire 10.

Figure 2:
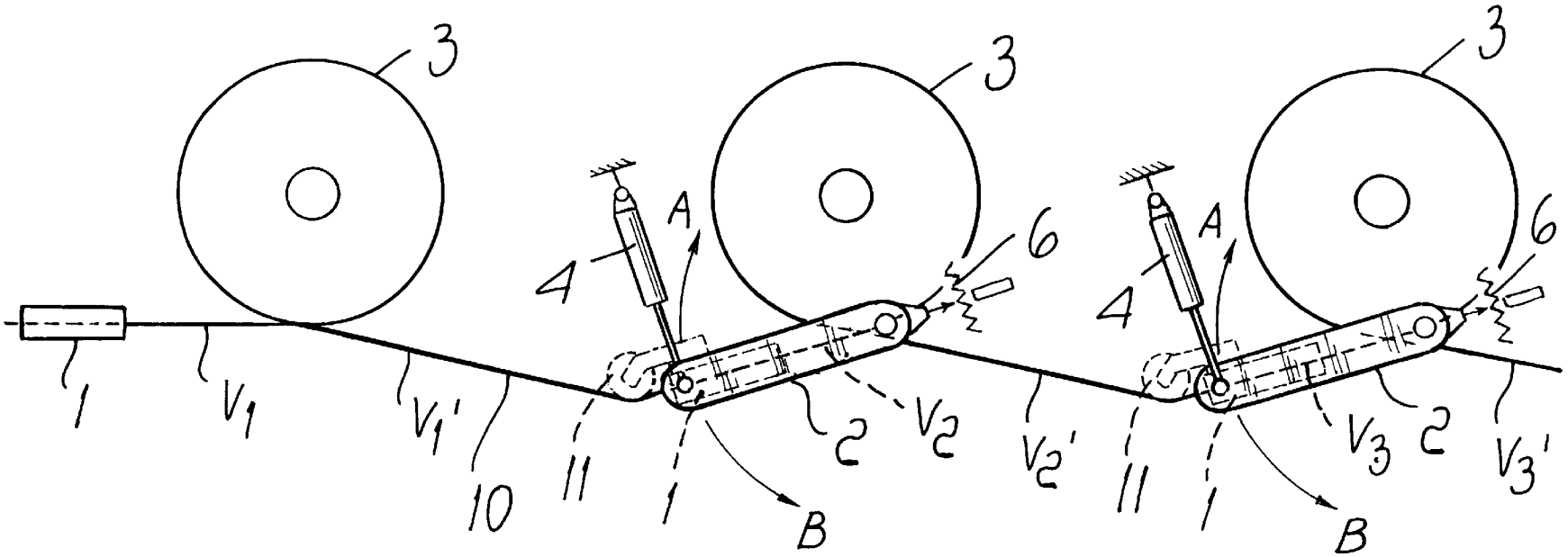
FIG. 2 is a schematic view of a second embodiment of the multipass wiredrawing machine according to the present invention.

FIG. 2 illustrates a second embodiment of the wiredrawing machine according to the present invention, wherein, differently from the first embodiment, the movable arm 2 is pivoted externally with respect to the center of the pulling reel 3, for example tangent to the traction line of the wire 10, or in any case in a position which allows to avoid variations in the length of the portion of wire 10 between the die 1 and the pulling reel 3.

For both embodiments, the movement of the movable arm 2 and of the corresponding die 1 activates sensor means 6, such as a position sensor 6, which is conveniently provided for example by means of an inductive transducer, a potentiometer, a proximity sensor, an encoder etcetera and acts on the elements that control the motor that drives the reel 3 involved, adjusting its rotation rate.

The movement of the die 1 along the arc A-B ensures that the synchronization speed is maintained, so that the various dies 1 remain at a median equilibrium position, determined by a central point of the sensor means 6, i.e., a point in which the sensor means detect no movement of the die and therefore emit no signal to slow down or speed up the pulling reel.

The movement of the die 1 in either direction along the arc A-B activates, by virtue of the sensor means 6, a signal which, by acting on adjustment means (not shown) of the corresponding motor that drives the pulling reel 3 adjusts its rotation rate, restoring synchronization among the various pulling reels 3 and accordingly returning the die 1 at said median equilibrium point.

In practice it has been observed that the wiredrawing machine according to the invention fully achieves the intended aim, since it allows to obtain a constant adjustment of the tension between the die and the reel and the next die without the aid of dancer rolls or sensors or similar systems for detecting wire tension changes.

The wiredrawing machine thus conceived is susceptible of numerous modifications and variations, all of which are within the scope of the inventive concept.

All the details may furthermore be replaced with other technically equivalent elements. Thus, for example, the various figures illustrate a multiple wiredrawing machine with reels having a horizontal axis; however, it is also possible to use reels having a vertical axis, superimposed horizontal reels, stepped vertical reels, etcetera.

For both embodiments shown in FIGS. 1 and 2 it is possible to provide, upstream of the dies 1, respective guiding pulleys 11 which are rigidly coupled to the die holder boxes and allow the wire to enter the dies in perfect alignment with the center of the dies.

In FIG. 2, the center of rotation of the arm 2 can be shifted with respect to the tangent to the reel 3.

Furthermore, the movement of the dies is described as occurring along an arc, but it is possible to provide for a different movement, provided that the above described wire tension conditions are maintained.

In practice, the materials used, so long as they are compatible with the specific use, as well as the dimensions, may be any according to the requirements and the state of the art.

The disclosures in Italian Patent Application No. I97A002514 from which this application claims priority are incorporated herein by reference.

I claim:

1. A multipass wiredrawing machine particularly for drawing metal wires which comprises a plurality of reels for pulling a wire that exits from a corresponding die, said reels being arranged mutually in sequence to wind the wire that exits from the die and guide it to a next die, wherein each pulling reel is fixed, while the corresponding die can move with respect to the corresponding pulling reel, in order to maintain a substantially constant length for a portion of wire with respect to the corresponding pulling reel and allow the length of the portion of wire to vary with respect to the preceding pulling reel, so as to provide constant adjustment of the tension of the wire between the die and the reel and between the reel and the next die, each die being actuated by actuation means.

2. The wiredrawing machine according to claim 1, wherein each die moves along an arc with respect to the corresponding pulling reel.

3. The multipass wiredrawing machine according to claim 2, wherein each die is connected to a corresponding movable arm actuated by said actuation means.

4. The wiredrawing machine according to claim 3, wherein each movable arm is pivoted to the rotation axis of the respective pulling reel, the arc of the movement of said die being centered at a point where said movable arm is pivoted.

5. The wiredrawing machine according to claim 3, wherein each movable arm is pivoted externally with respect to a center of the corresponding pulling reel.

6. The wiredrawing machine according to claim 3, wherein each movable arm is pivoted externally with respect to a center of the corresponding pulling reel, tangent to a traction line of said wire, in order to maintain a constant length of the portion of wire between the die and the corresponding pulling reel, the arc of the movement of said die being centered at a point where said movable arm is pivoted.

7. The wiredrawing machine according to claim 1, further comprising means for detecting the position of said reel which are adapted to actuate means for adjusting a rotation rate of said reel as a function of the detected position.

8. The wiredrawing machine according to claim 1, further comprising a guiding pulley which is arranged upstream of each die in order to center the insertion of the wire into the respective die.

* * * * *